United States Patent [19]

Hryhorczuk

[11] 4,233,767

[45] Nov. 18, 1980

[54] KIT FOR MAKING A MULTIPLE VIEW PICTORIAL DISPLAY DEVICE

[75] Inventor: Dmytro Hryhorczuk, Chicago, Ill.

[73] Assignee: Artex International Corporation, Chicago, Ill.

[21] Appl. No.: 930,901

[22] Filed: Aug. 4, 1978

[51] Int. Cl.[3] ..... G09F 19/14

[52] U.S. Cl. ..... 40/453; 40/437

[58] Field of Search ..... 40/453, 454, 427, 436, 40/437, 615; 428/29

[56] References Cited

U.S. PATENT DOCUMENTS

| | | | |
|---|---|---|---|
| 942,498 | 12/1909 | Heinemann | 40/453 |
| 1,353,363 | 9/1920 | Simon | 40/453 |
| 2,088,762 | 8/1937 | Rous | 40/453 |
| 3,406,476 | 10/1968 | Wilcox | 40/453 |

FOREIGN PATENT DOCUMENTS

| | | | |
|---|---|---|---|
| 327924 | 7/1903 | France | 40/453 |
| 1083929 | 1/1955 | France | 40/453 |

*Primary Examiner*—John F. Pitrelli
*Assistant Examiner*—G. Lee Skillington
*Attorney, Agent, or Firm*—Silverman, Cass & Singer Ltd.

[57] ABSTRACT

A kit of multiple parts to be assembled for fabricating a multiple view pictorial display device that provides displays of different images when viewed frontally from different angles relative to the plane of the device.

13 Claims, 9 Drawing Figures

FIG. 1
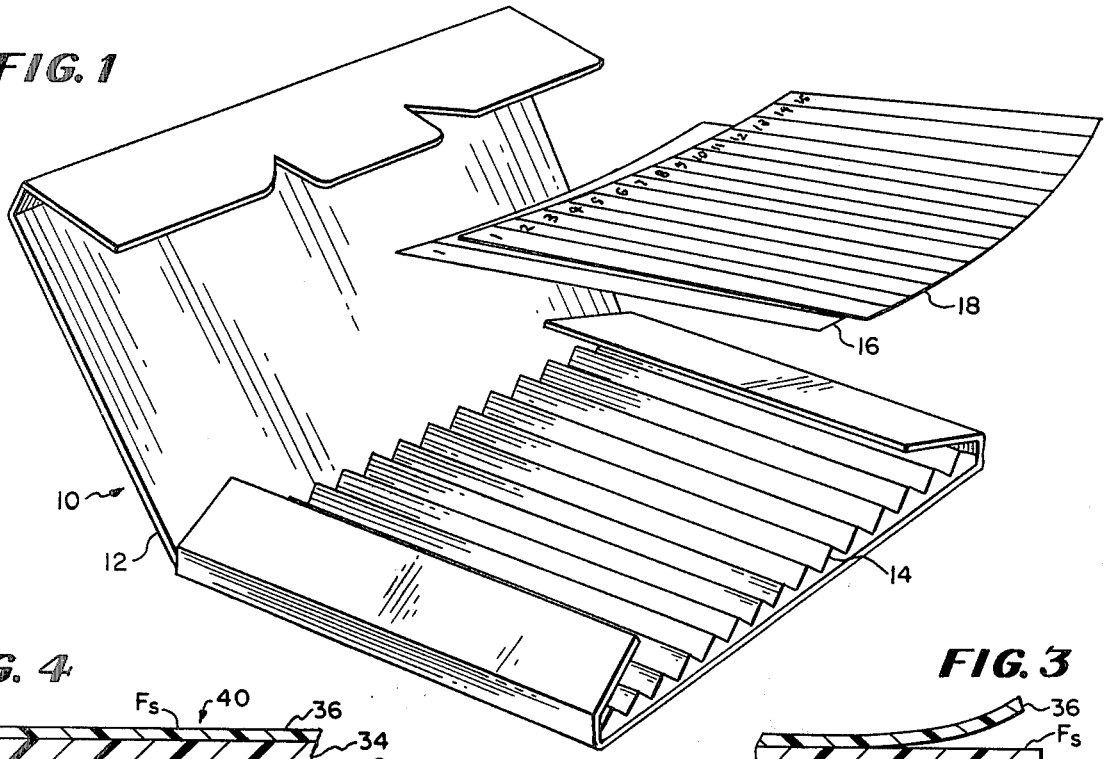
FIG. 4
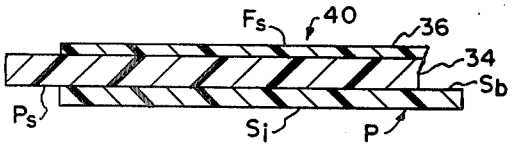
FIG. 3
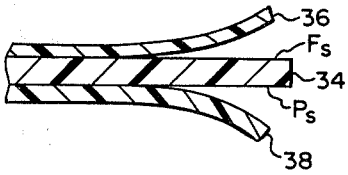
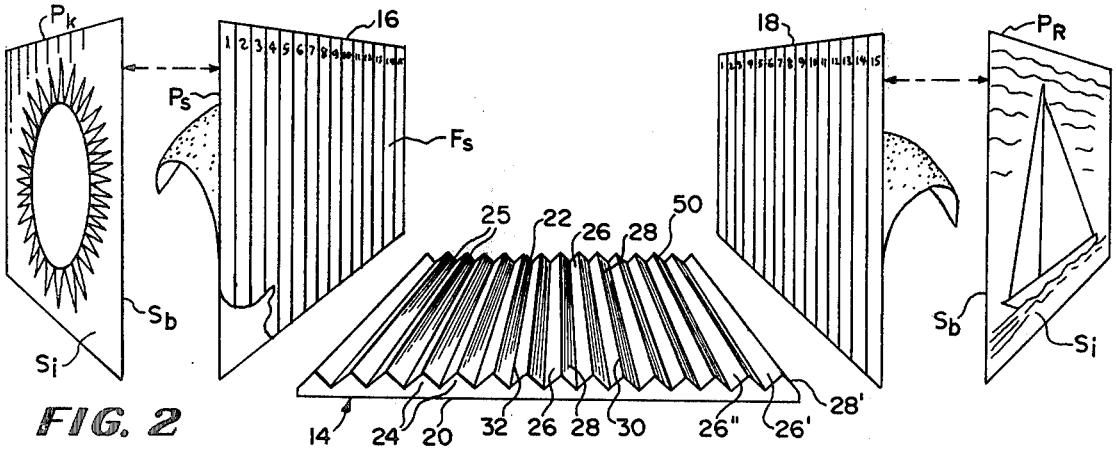
FIG. 2
FIG. 5
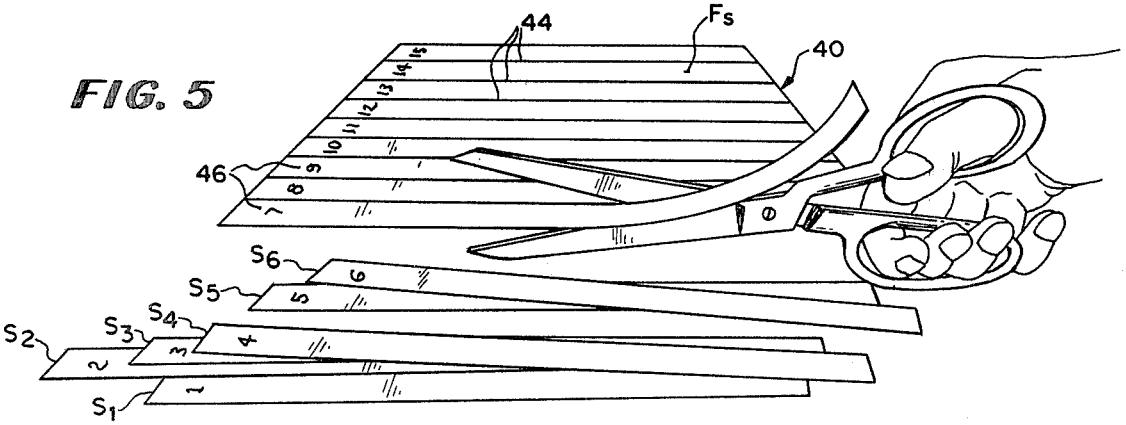

FIG. 6
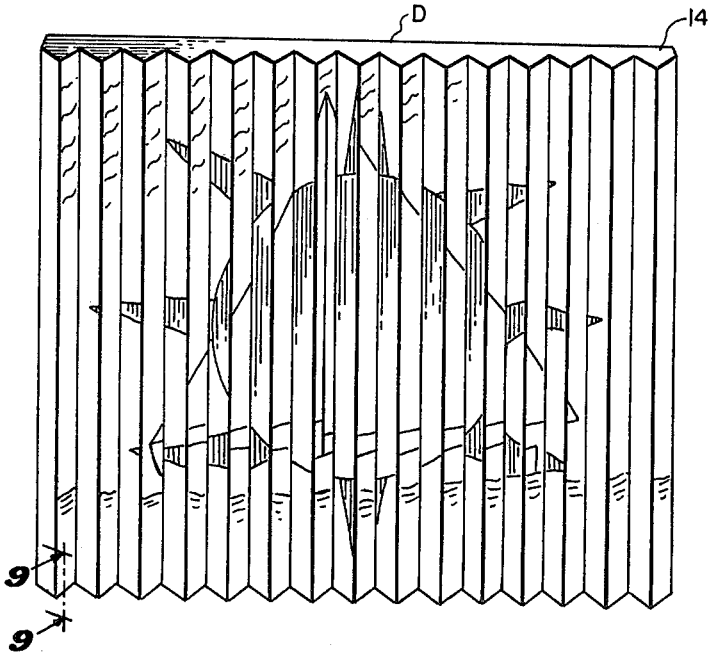
FIG. 7
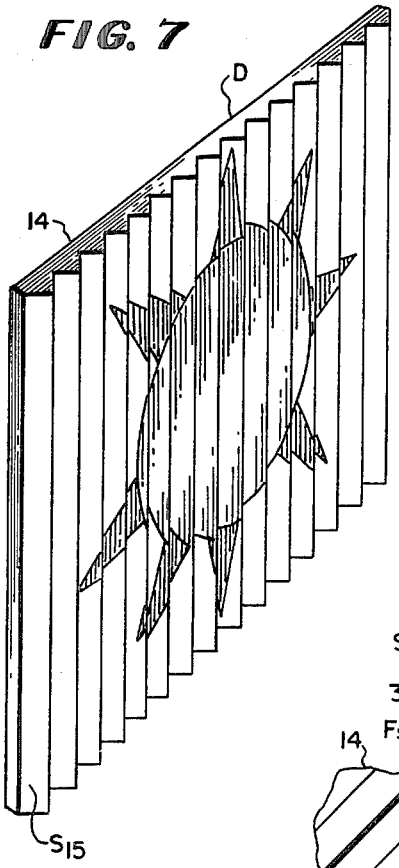
FIG. 8
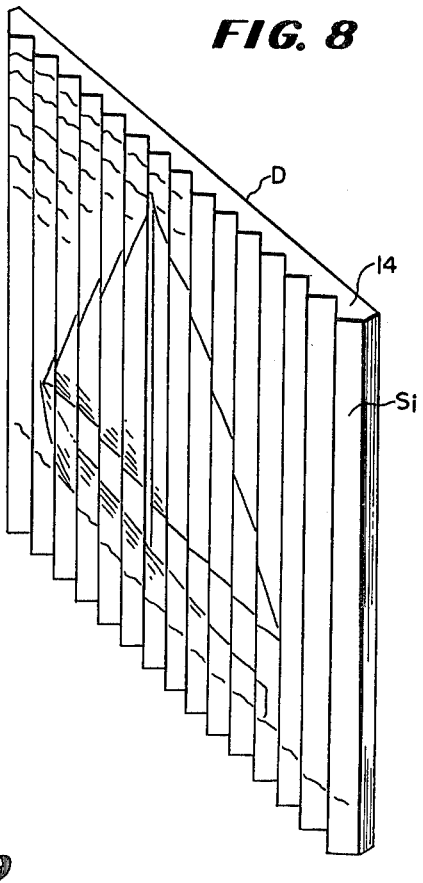
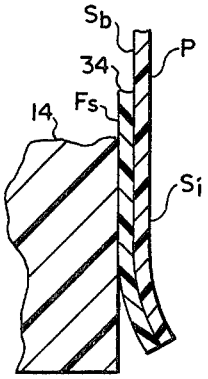
FIG. 9

KIT FOR MAKING A MULTIPLE VIEW PICTORIAL DISPLAY DEVICE

BACKGROUND OF THE INVENTION

This invention relates generally to a kit for fabricating a display device and more particularly, to a kit comprised of a plurality of novel component parts adapted to be assembled according to prescribed instructions accompanying the kit for providing a pictorial display device capable of providing different pictorial images when the device is viewed frontally from different angles relative to the vertical plane of the device. Further, the invention relates to a novel pictorial display device derived from such a kit.

Certain art forms, such as generally planar devices which display different images or pictures when viewed from different frontal angles, are known. To create this illusion in these known devices, the desired pictures are superimposed one on the other and specific light refracting means are located in front of the superimposed pictures. Consequently, the line of sight of the viewer is directed by these refracting means toward either of the two pictures depending upon the angle that the line of sight takes relative to the defracting means.

One disadvantage of such known devices is the complexity which contributes to the inability of unskilled hobbyists to assemble and fabricate them. Further, the costs of coatings and light refracting means for these devices can be prohibitively expensive for the hobbyist.

United States patents which illustrate multiple view pictorial devices of the general type to which this invention pertains are as follows: Jacobson U.S. Pat. No. 624,043; Saalburg U.S. Pat. No. 1,449,914; Russel U.S. Pat. No. 1,579,249; Rowland U.S. Pat. No. 3,357,772; and Cahn U.S. Pat. No. 3,856,592.

SUMMARY OF THE INVENTION

This invention provides a kit comprised of specially constructed component parts adapted to be assembled in a preferred sequence and manner. The kit includes a support frame having a corrugation-contoured mounting front side and a pair of indicia or pictorial display carrier cards. By reason of said corrugation contour, there is provided a series of ridges and valleys which defines at least two alternately arranged groups of similiar, spaced mounting surfaces, the surfaces of each group being angled relative to one another, such as in the case of two sides of a triangle.

The display carrier card comprises a substrate member of suitable thin sheet material which can be severed readily into strips using a scissor or other suitable cutting instrument which can be easily manipulated by a hobbyist. The carrier member has a so-called image display face and an opposite face or backside. The image display face is intended to amount a pictorial or other selected artistic image to provide what is called herein, a pictorial display assembly. The backside or opposite face of the carrier card has a series of spaced, parallel lines delineated spanned across the length of the card. The hobbyist will be directed to sever or cut this pictorial display assembly carefully along these lines, which have been coded for a purpose to be explained, to provide a series of coded narrow strips of identical size and configuration. This procedure is followed for each carrier card to which a different pictorial or artistic display has been mounted. Each strip is sized to register identically with a ridge or corrugation surface of the support frame.

The strips are sized and coded so that when installed, they will cover precisely the respective support frame corrugation or ridge surfaces with one picture being applied only to one group of such surfaces and the other picture being applied to the other group of such surfaces. The coding means is provided to enable the strips to be mounted in their preselected desired order to achieve the pictorial display. The cards are precoated on both sides with adhesive to facilitate bonding initially to the image and subsequently to the support frame mounting surfaces.

BRIEF DESCRIPTION OF THE DRAWINGS

FIG. 1 is a perspective view of the kit in its initial packaged arrangement showing the carton opened, several carrier cards removed from the carton and the support frame in the carton;

FIG. 2 is an exploded perspective view showing components of the kit preparatory for assembly into a display device;

FIG. 3 is an enlarged fragmentary sectional view taken through a carrier card;

FIG. 4 is an enlarged fragmentary sectional view taken through said card bonded to the selected picture forming the picture preassembly;

FIG. 5 is a perspective view of the carrier with display and shown being severed to provide the elongated strips;

FIG. 6 is a front plan view of the finished multiple view display device formed from the various components illustrated in FIG. 2;

FIGS. 7 and 8 respectively are frontal views taken from opposite viewing angles relative to the plane of the device illustrated in FIG. 6 and showing the different images visible from different angular vantage points;

FIG. 9 is a fragmentary enlarged sectional view taken along the line 9—9 in FIG. 6 and in the direction indicated.

DETAILED DESCRIPTION OF THE INVENTION

Referring now to the drawings, the reference character 10 designates generally the kit embodying the invention. The component parts of the kit are retained in a storage container or shipping carton 12 formed preferably of inexpensive corrugated paperboard as a thin, rectangular package. Said components include a mounting board or frame 14 and a pair of carrier cards 16 and 18 which are illustrated exploded from the carton 12.

The mounting board 14 preferably is formed of molded plaster or other suitably rigid material. The board has a flat rear surface 20 and a front surface 22 by generally corrugated contour. The corrugations provide a plurality of spaced ridges or ribs 24 and valleys 25. Each ridge 24 has a pair of surfaces 26 and 28 which are canted or angled one relative to the other and joined at an apex 30. Adjacent ridges have surfaces joining at a crotch 32 in the valley between said adjacent ridges. Thus the surfaces 26 and 28 of a rib face away one from the other. However the surface 26 of one ridge face the surface 28 of an adjacent ridge. All surfaces 26 will face in the same direction. All surfaces 28 will face in the same direction. When looking at mounting board 14 as oriented in a vertical plane as seen in FIG. 6, the surfaces 26 face to the left and the surfaces 28 face to the right.

The leftward facing surfaces 26 are shown parallel to one another and the rightward facing surfaces 28 are shown parallel to one another. The surfaces 26 and 28 of a ridge are arranged substantially at right angles to one another, and at approximately 45° relative to the rear wall 20. The apices 30 lie in one common plane spaced above the plane connection crotches interior 32 and these planes are parallel to one another and to the rear wall 20.

Each of the carrier cards 16 and 18 are substantially identical in construction such that a typical section of such a card is illustrated in FIG. 3. The card 16 includes a planar body 34 which preferably is precoated with adhesive on each of its exterior faces Fs and Ps, and a peelable backup sheet 36 and 38 covers each adhesive coating. FIG. 3 illustrates each of the sheets 36 and 38 peeled away slightly for illustrative purposes to be alluded to hereinafter.

Referring to FIG. 2, there is shown a selected left pictorial display sheet Pk and a selected right pictorial display sheet Pr positioned respectively to cards 16 and 18. It will be understood that each display sheet has an exposed image side Si and an opposite backside Sb. The display sheets preferably are formed of paper or other suitable material on which an image has been printed or otherwise provided.

In use, each card initially is bonded with its picture display side Ps flush against the backside Sb. This is readily accomplished by peeling away the backing sheet 38 and adhesively securing same to the mounting card. This defines a picture preassembly 40 illustrated in FIG. 4 where the interior body 34 of the card is adhered with its face Ps to the backside Sb of the picture P and where there yet remains the protective backup sheet 36 covering the precoated adhesive on opposite side of the card. The preassembly 40 is illustrated also in FIG. 5, with the indicia card side being faceup and the image side Si being face down.

At this stage, each picture preassembly 40 then is cut into elongate strips or segments which are identified as S1, S2, S3, S4, S5, and S6 in FIG. 5, with the remaining strips being shown in their precut configurations. To aid in accurate cutting of the preassembly 40, a plurality of indicia lines or markings 44 is provided on the exposed frame side Fs of the indicia card. In the illustrated embodiment, the markings 44 are parallel to and equally spaced from one another and thereby define separate rectangular strips of similar size. As illustrated, the preassembly 40 is to be subdivided into fifteen strips.

There are additional code markings 46 in the form of numbers 1 through 15 respectively illustrated on the frame side Fs of the indicia card which are used to correlate proper positioning of the separate strips to one another and maintain them in the same adjacent and sequential relationship as in their pre-cut assembly. Thus, it is only necessary to maintain all of the indicia numbers, for example, at corresponding top ends of the stack of strips and to the use the numbering code in determining the order the strips are to be applied to the support frame 14.

The frame side Fs of the picture pre-assembly 40 is adapted to be bonded to the mounting surface 26 or 28 of the mounting board 12. In order to maintain the picture in proper orientation, it is necessary to reverse in a right to left manner the orientation of the pre-cut sequencing of the preassembly relative to the bonded condition thereat on the mounting frame. Thus, the left-most identified strip S1 of the left picture preassembly would be applied to the rightmost face 26' in FIG. 2, with the sequence number indicia 46 being adjacent to the upper edge 50 of FIG. 2. The adjacent strip S2 correspondingly would be placed on the adjacent mounting surface 26''; and each successive adjacent strip would be bonded likewise to the next successive adjacent mounting surface 26. The same procedure is followed with the preassembly 40 of the right picture PR, the appropriate left-most strip S1 being bonded to the right-most mounting surface 28' and the indicia markings 46 being closely adjacent the top edge 50. Again, in the preferred embodiment it is necessary only to remove the back up sheet 36 to expose the adhesive coating on the frame side FS of the inidica card 16 to complete this bonding.

The picture Pk or PR is selected to be larger than the indicia cards 16 and 18 so that any excess of the picture extending beyond the edges of the indicia card is trimmed away prior to subdividing the picture preassembly.

The finished multiple view picture display D is illustrated in FIGS. 6, 7 and 8 where the direct frontal view visible FIG. 6 illustrates a combination of images derived from the two pictures Pk and PR. Only picture P1 can be seen in FIG. 7 and similarly, only picture PR can be seen in FIG. 8, thus representing the two different images perceived when viewing the mounting board from different angles relative to the plane normal to the plane of the mounting board and on opposite sides of said normal plane.

Although the illustrated preferred mounting card has both its picture side Ps and its frame side Fs precoated with adhesive and protectively covered with a backup sheet, it would be possible to vary this. For example, one could provide a moisture or pressure sensitive precoated adhesive on the surfaces which might not require a protective peel away sheet. It could be feasible to eliminate the adhesive entirely, particularly on the picture side Ps of the indicia card, and to apply available adhesives onto the indicia card at the time of use.

Also, the manner of correlating the elongate strips and maintaining them in proper sequence relative to each other and to the support frame can be varied. A color system might be used with each strip and the mounting surface on the support frame would bear an indicia (not shown) which would correspond to the indicia on the frame side FS of the indicia card. In the illustrated embodiment, the actual indicia 46 are formed on the removable peel-away backup sheet.

The dimensions of each surface 26 or 28 can vary as well as the number of such surfaces, but in a practical embodiment, each surface generally was dimensioned between $\frac{1}{4}$ and $\frac{3}{4}$ of an inch in width and approximately 9 to 10 inches long. The surfaces 26 and 28 are shown angled at right angles relative to one another, but this angle can be varied although it should be maintained between approximately 60 degrees and 120 degrees. The angular relationships of the surfaces 26 and 28 changes the illusion that is perceived in reference to the line of sight that the viewer must maintain in order to have the images change, but the angles given above represent a practical and pleasing combination. Likewise, the number of individual ribs and thereby opposing mounting surfaces 26 and 28 can vary depending upon the size of the surfaces themselves as well as the size of the overall board 14. Preferably, between one and four or five ribs per inch width of picture is practical. In a practical embodiment, fifteen separate ribs would correspond to thirty picture segments each approximately ½" in width and would contribute to a picture having 10–12 inches overall width.

In considering the type pictures which could be used, the pictures could compliment one another, such as the sun and a sail boat, or can be entirely contradictory to one another. In fact, the pictures could even be identical one to the other but shifted in a manner, either angularly or laterally, so that when the final picture D were viewed from different frontal angles, a different combination of images would be perceived.

Even though the kit is illustrated with the support frame having only two groups of mounting surfaces, it would be possible to increase this number to three or possibly even four such surfaces and to use corresponding three or four different pictures. For example, each front exterior corner could be interrupted with a flat surface interposed between the two angled surfaces 26 and 28 and/or each rear interior corner could be interrupted with a flat surface interposed between two surfaces 26 and 28. The interposed surface might preferably be parallel to the rear face of the support frame. If only one such interrupting surface were used, a three picture image would be developed; whereas if both front and rear interrupting surfaces were used, a four picture multiple view display would be provided.

A further possible variation would be to have the corrugations formed with all the interior and exterior corners lying in the same planes, respectively, but with them curved in a "S" type wave fashion when viewed from a 90 degree frontal angle. The indicia lines used for subdividing the picture pre-assembly would then be of like "S" wave shaped contours.

A further possible variation in the multiple view picture would be to provide that the exterior and interior corners defined between the sloped mounting surfaces not all lie in single spaced parallel planes respectively, but assume three-dimensional contours. This would vary the width of the mounting surfaces and the elongate strips to cover same; which then would have non-parallel and wavy side edges.

The above listed variations would follow the same disclosed basic concept of this invention, but would add significantly to the possible variations to be experienced by the viewer. They would be limited only by the complexity of making the kit or of using the kit. In all such illustrations, the indicia markings on the indicia card would be coded in such a manner that the cut strips of the picture preassembly would be designed to fit exactly complimentary onto the supporting appropriate mounting surfaces of the support frame and further to maintain such strips in the same adjacent side by side relationship on the finished multiple view picture as on the pre-cut picture preassembly.

The illustrated support frame can be fabricated of a compressed fiber or a plastic material, formed for example by compression molding between two complimentary mold faces. Similarly, the indicia cards could be formed of a fiber composition or of a synthetic or plastic composition. The adhesive could be moisture or pressure sensitive, and further could be applied to either or both the picture side and frame side of the indicia card. Likewise, the peel off backing sheet can be of a paper or of a plastic or synthetic composition.

The frontal view picture is illustrated with the ribs or mounting surfaces running vertically when the picture is displayed for viewing. This would be desirable since the most common variable in frontally viewing a picture would be the horizontal variable experienced by merely walking past it. It would be possible, however to utilize the picture with the mounting surfaces angled other than vertically, such as horizontally, at some or angle therebetween.

The illustrated vertically running ribs, however, do provide a leftmost rib and a rightmost rib when referenced by frontally viewing same, and correspondingly, the mounting cards are subdivided to define leftmost and rightmost elongate strips. Reference is made in the claims to this orientation which is useful in the assembly of the multiple view picture.

What is desired to secure by Letters Patent of the United States is:

1. A kit for making a multiple view pictorial display device which enables different pictorial images to be viewed depending upon an appropriate angle of sight of the viewer relative to the frontal plane of the display device and the displacement of the viewer to the left or right of a plane normal to said frontal plane, the kit enabling an unskilled user to choose any pictorial image and adapt said image for mounting on said display device, said kit including:

(a) a mounting board having a surface of corrugation-contour which provides alternately spaced ridges and valleys, spanning the distance between a pair of opposite side edges of the board and entirely across said board, each ridge having a pair of mounting surfaces canted one relative to the other and conjoined at an apex along the entire length of the ridge;

(b) a carrier card for each chosen pictorial image to be displayed on the device, which pictorial image can be extraneous to the kit, each card having an image side and a mounting side, the chosen pictorial image being mountable on said image side, i. said image side being adapted to have the chosen pictorial image fixedly secured thereon and covering said side, the pictorial image being secured to the image side of the carrier card by the user of the kit on assembly of the display device, ii. said mounting side having indicia selectively arranged thereon for severing the card and attached pictorial image into substantially identical strips and coding means disposed on the mounting side for maintaining the sequential arrangement of the strips correlated to their sequential arrangement prior to such severing of the card and attached image, (c) said coding means enabling the strips obtained from one card to be mounted individually on a selected one of the mounting surfaces of a ridge and the strips obtained from the other of said cards to be mounted individually on the second mounting surface with the image sides of the resulting strips being exposed, (d) the resulting orientation of the exposed image sides being selected so that the strips obtained from one card all face in the same direction and the strips obtained from said second card face in the same direction albeit said directions being opposite one relative to the other, (e) said coding means enabling said strips of the individual cards to be mounted to the board consistent with said desired sequential arrangement thereof when severed such that only the intact image of one card is visible to a viewer displaced to the left and the intact image of the other card is visible to a viewer displaced to the right of said normal plane and at the appropriate angle of sight in each instance such that different pictorial images are viewable at the discretion of the viewer, the coding means disposed on the mounting side of the strips not being visible to said viewer.

2. The kit according to claim 1 in which said mounting surfaces facing in the same direction are spaced apart and parallel one relative to the other.

3. The kit according to claim 2 in which the mounting surfaces facing in the same direction are substantially identical in size and configuration.

4. The kit according to claim 2 in which said mounting surfaces facing in one direction are angled relative to the oppositely facing mounting surfaces between 60° and 120°.

5. The kit according to claim 1 in which at least those mounting surfaces facing in the same direction and the mounting side of at least one card have means for mounting the strips to the mounting surfaces.

6. The kit according to claim 5 in which said means for mounting the strips comprises adhesive.

7. The kit according to claim 5 in which a peelable protective cover sheet is affixed over said adhesive.

8. The kit according to claim 1 in which said carrier card has means for mounting a pictorial image to the image side thereof.

9. The kit according to claim 8 in which said mounting means comprise adhesive disposed on the image side of the carrier card and further comprising a peelable protective cover sheet affixed over said adhesive, the cover sheet being removable to allow the chosen pictorial image to be secured to the image side of the carrier card by the user of the kit.

10. The kit according to claim 1 in which each carrier card has a pictorial image on the image side thereof.

11. The kit according to claim 1 which includes additionally a pictorial display sheet constructed and arranged to be mounted to the image side of each carrier card.

12. The kit according to claim 1 in which said coding means comprise characters of indicia selected to enable maintenance of said desired sequential arrangement and mounting of the severed strips obtained from individual carrier cards.

13. The kit according to claim 1 in which coding means comprise selected color indicia.

* * * * *